United States Patent [19]

Rohde et al.

[11] Patent Number: 5,000,020

[45] Date of Patent: Mar. 19, 1991

[54] METHOD AND ARRANGEMENT FOR CONTROLLING THE THICKNESSES OF WEBS AND FLANGES OF BEAMS IN UNIVERSAL ROLLING MILL STANDS

[75] Inventors: Wolfgang Rohde, Dormagen; Dieter Rosenthal, Niederfischbach, both of Fed. Rep. of Germany

[73] Assignee: SMS Schloemann-Siemag Aktiengesellschaft, Fed. Rep. of Germany

[21] Appl. No.: 316,426

[22] Filed: Feb. 27, 1989

[30] Foreign Application Priority Data

Feb. 26, 1988 [DE] Fed. Rep. of Germany ..... 3806063

[51] Int. Cl.[5] ..... B21B 37/08; B21B 37/12

[52] U.S. Cl. ..... 72/8; 72/11; 72/16; 72/20; 72/225

[58] Field of Search ..... 72/16, 20, 21, 225, 72/240, 245, 8, 11, 12, 19

[56] References Cited

U.S. PATENT DOCUMENTS

| | | | |
|---|---|---|---|
| 4,343,167 | 8/1982 | Hasegawa et al. | 72/8 |
| 4,702,099 | 10/1987 | Sturm | 72/20 X |
| 4,711,109 | 12/1987 | Rohde et al. | 72/8 |
| 4,760,723 | 8/1988 | Nakagawa | 72/8 |
| 4,805,492 | 2/1989 | Tsuruda | 72/8 |

*Primary Examiner*—E. Michael Combs
*Attorney, Agent, or Firm*—Toren, McGeady & Associates

[57] ABSTRACT

A method and an arrangement for controlling the thicknesses of webs and flanges of beam sections in universal rolling mill stands. A gage-meter circuit is provided for each roll of the universal rolling mill stand. In order to maintain a certain ratio of web elongation to flange elongation, the gage-meter circuits are coupled to each other for a mutual influencing. The adjustment can be effected in dependence on a rolling schedule.

7 Claims, 1 Drawing Sheet

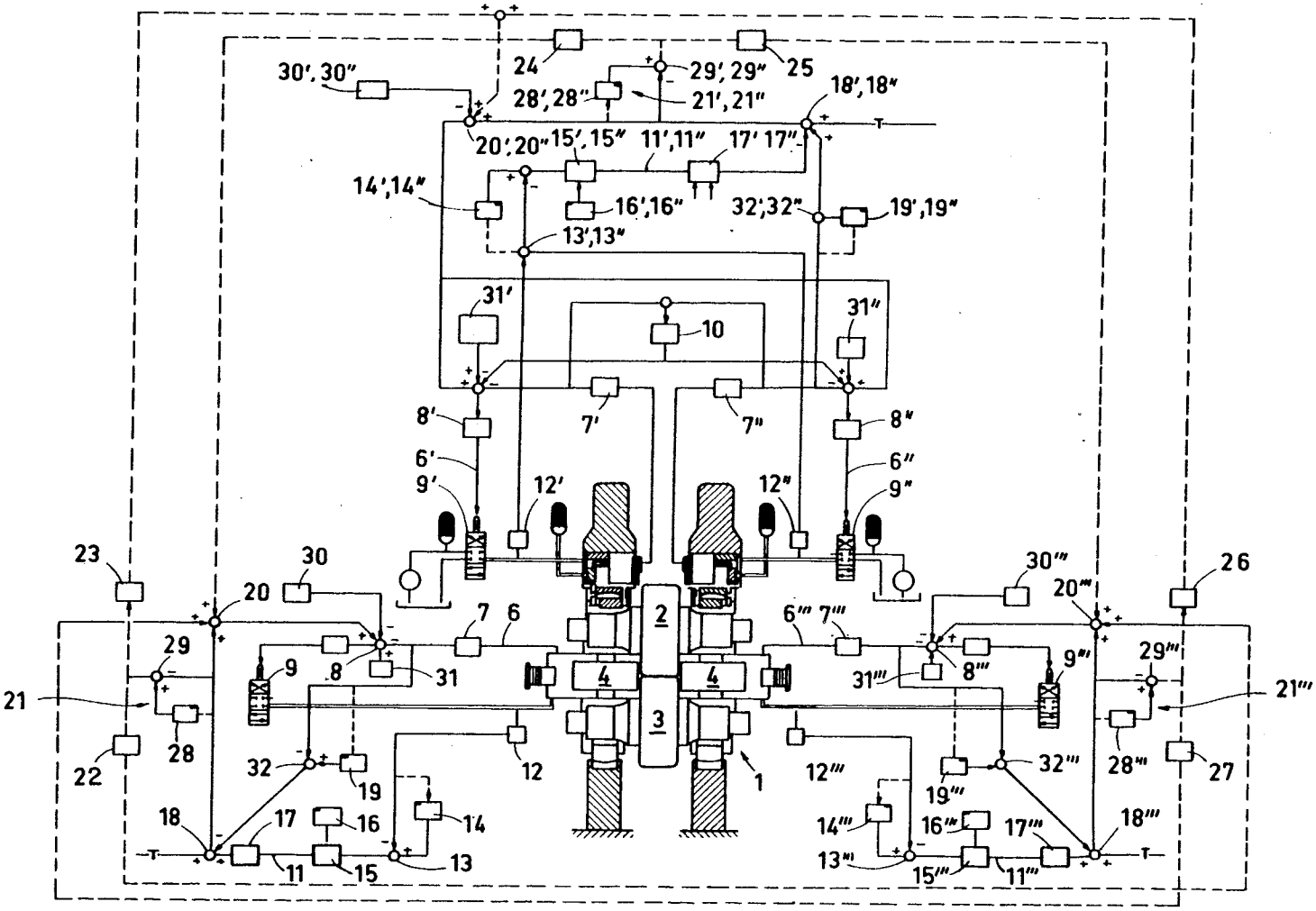
1
2
3
4
4
6
6'
6''
6'''
7
7'
7''
7'''
8
8'
8''
8'''
9
9'
9''
9'''
10
11
11'
11''
11'''
12
12'
12''
12'''
13
13'
13''
13'''
14
14'
14''
14'''
15
15'
15''
15'''
16
16'
16''
16'''
17
17'
17''
17'''
18
18'
18''
18'''
19
19'
19''
19'''
20
20'
20''
20'''
21
21'
21''
21'''
22
23
24
25
26
27
28
28'
28''
28'''
29
29'
29''
29'''
30
30'
30''
30'''
31
31'
31''
31'''
32
32'
32''
32'''

METHOD AND ARRANGEMENT FOR CONTROLLING THE THICKNESSES OF WEBS AND FLANGES OF BEAMS IN UNIVERSAL ROLLING MILL STANDS

BACKGROUND OF THE INVENTION

1. Field of the Invention

The present invention relates to a method for controlling the thicknesses of webs and flanges of beam sections in universal rolling mill stands by means of gage-meter circuits provided for the horizontal rolls and the vertical rolls. The present invention also relates to an arrangement for carrying out this method.

2. Description of the Related Art

It has been found in rolling sections, for example, I-sections, that deviations occur in the thicknesses of the webs and/or flanges of the sections. These deviations may be long-time deviations caused, for example, by the continuously occurring wear of the rolls or by temperature-related expansions of the rolls. The deviations may also be short-time deviations caused, for example, by temperature variations or by differences in the material in the section to be rolled.

In the past, it was attempted to eliminate the deviations by position-controlled mechanical adjustments. However, mechanical adjustments did not result in substantial progress because this type of adjustment operates very slowly and inaccurately, so that it was hardly possible to counteract the short-time deviations.

In addition, when the I-sections are rolled, the elongation of the web is to be 2 to 4% greater than the elongation of the flanges. When the above-mentioned known controls were used, it was easily possible that the differences in length were smaller or greater than required, and, thus, departed from the tolerance range, which created instabilities in sections.

It has also been attempted to use gage-meter controls which were known from strip rolling. However, in this method, mechanical adjustments were also used, so that the deviations which were recognized could not be eliminated quickly enough. This method also caused deviations from the required differences in length of the web and flanges.

It is, therefore, the primary object of the present invention to provide a method for the optimum compensation of the thicknesses of webs and flanges. Also, an arrangement for carrying out this method is to be provided.

SUMMARY OF THE INVENTION

In accordance with the present invention, the method for controlling the thicknesses of webs and flanges of beams in universal stands includes hydraulically adjusting each roll to predeterminable positions thereof by means of at least one position control circuit, compensating short-time deviations through a gage-meter circuit provided for each roll by measuring the rolling forces by means of actual pressure value indicators provided at the hydraulic adjusting cylinders and entering additional desired values, resulting from force differences between a reference force and the measured rolling force, into the position control circuit as a first correction value, determining and compensating long-time deviations by sensors and/or regulating units which determine and/or preset the deviations and/or by models computed in dependence on the rolling schedule and entering in the respective position control circuit as a second correction value. The method further includes presetting the degree of the compensation of short-time deviations to be carried out (penetration), coupling the gage-meter circuits to each other for the mutual influencing of the short-time deviation compensation and presetting the initiation of the coupling of the gage-meter circuits to each other for the full or partial compensation of secondary short-time deviations occurring during a control procedure, wherein material-dependent and rolling-technological interrelations during coupling can be called from storage-coupling circuits.

The use of hydraulic adjustments facilitates an accurate and quick positioning. In addition, it is easily possible to realize a protection against excess pressure. The coupling of the gage-meter circuits ensures that the relationship between elongation of web and elongation of flanges remains within the tolerance range. By means of the selectable degree of coupling, it is possible to adjust the extent by which deviation corrections of the web or flange are actually to be effected at the flange and the web. As a result, it is ensured that no secondary deviations can occur. In this connection, secondary deviations are, for example, of the type in which a deviation correction at the web with 100% coupling would also result in a change of the flange adjustment even though the flanges may actually have the exactly correct dimensions. A change in the adjustment for the flanges would in this case result in a secondary deviation.

Attenuating units in each gage-meter circuit make it possible to adjust the penetration, i.e., the degree of deviation compensation in the respective gage-meter circuit. For example, it may be appropriate to compensate the deviations only by 50%, while remaining in the tolerance range of the relationship of the elongations of the web and flanges and, thus, obtaining a section with accurate dimensions.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there is illustrated and described a preferred embodiment of the invention.

BRIEF DESCRIPTION OF THE DRAWING

In the drawing:

The single figure of the drawing shows schematically and in section a universal rolling mill stand and a diagram of a control arrangement for the universal stand.

DESCRIPTION OF THE PREFERRED EMBODIMENT

As illustrated in the drawing, a universal rolling mill stand 1 has horizontal rolls 2 and 3 and vertical rolls 4 and 5. Horizontal roll 2 and vertical rolls 4 and 5 are hydraulically adjustable, while the horizontal roll 3 is only mechanically adjustable by means of sets of shim plates, not shown.

For each adjusting cylinder is provided a position control circuit 6, 6', 6'', 6'''. In order to simplify the drawing, only one adjusting cylinder is shown for the vertical rolls 4, 5 while the upper horizontal roll has an adjusting cylinder for each roll neck. Each position control circuit 6, 6', 6'', 6''', includes a position pickup 7, 7', 7'', 7''' and a position comparator 8, 8', 8'', 8''' in which the measured position is compared to a position predetermined by a desired position value indicator or generator 31, 31', 31'', 31'''. The initial value of the position comparator 8, 8', 8'', 8''' serves to control a valve 9, 9', 9'', 9''' through which the respective piston-cylinder units of the hydraulic adjusting means are actuated. The position pickups 7', 7'' are provided with a synchronization circuit 10 which compensate the differences between the determined position values so as to ensure an exact adjustment of the upper horizontal roll 2.

The hydraulically adjustable rolls 2, 4, 5 are each additionally provided with a gage-meter circuit 11, 11', 143 11'', 11'''. Each gage-meter circuit 11, 11', 11'', 11''' has a device for determining the rolling force, i.e., an actual pressure value indicator or generator 12, 12', 12'', 12''' an adder 13, 13', 13'', 13''', a reference rolling force storage 14, 14', 14'', 14''', a multiplier 15, 15', 15'', 15''', a stand module storage 16, 16', 16'', 16''', an attenuating member 17, 17', 17'', 17''', an adder 18, 18', 18'', 18''', a reference roll position storage 19, 19', 19'', 19''', a position comparator 32, 32', 32'', 32''' and an adder 20, 20', 20'', 20'''. The gage-meter circuits 11, 11', 11'', 11''' are connected to each other through the adders 20, 20', 20'', 20''' and the coupling circuits 21, 21', 21'', 21'''. The coupling circuits 21, 21', 21'', 21''' include storage coupling circuits 22, 23, 24, 25, 26, 27 in which are stored material-dependent, rolling-technological relationships which are capable of influencing the degree of coupling of the gage-meter circuits 11, 11', 11'', 11''', The operation of the gage-meter circuits 11, 11', 11''. 11''' shall now be described. The actual rolling force of each roll is measured by means of actual pressure value generators 12–12'''. The signal of the actual pressure value generators 12–12''' is added in adder 13–13''' to a reference force signal from storage 14–14'''. The reference force signal may be placed manually in the storage or by measuring the force and storing it during the initial pass.

The initial signal of the adder 13–13''' is divided in the multiplier 15–15''' by a stand module which is dependent on the rolling schedule and is placed in the storage 15–15''' and, subsequently, the signal is switched onto the attenuating member 17–17'''. The penetration of each gage-meter circuit 11–11''' is adjustable by means of the attenuating member 17–17'''. This adjustment can take place manually or by means of a storage, not shown, in which penetration values for specific rolling schedules are stored.

A comparative signal formed from the reference position signal and the actual position signal and any manually entered correction signals are added in adder 18–18''' through the initial signal of the attenuating member 17–17'''. The reference position signal may be entered directly to the storage 19–19''' or by determining the position and storing the position during the initial pass. The initial signal of the adder 18–18''' is switched through the adder 20–20''' to the respective position comparator 8–8''' and is transformed in the position comparator 8–8''' into adjusting signals, as described above.

The initial signal of the adder 18 is simultaneously switched through the coupling circuit 21 onto the adders 20', 20'', 20''', while the initial signal of the adder 18', 18'' is switched through the coupling circuit 21', 21'' to the adders 20, 20''' and the output signal of the adder 18''' is switched through the coupling circuit 21''' to the adders 20, 20', 20''. As a result, a mutual influencing of the gage-meter circuits 11–11''' is possible.

The coupling circuit 20–20''' includes a storage 28–28''' and an adder 29–29'''. The storage 28–28''' is switchable in such a way that it continuously switches the output signals from the adder 18–18''' to the adder 29–29''', where the initial signals are subtracted from themselves, so that "0" exists at the output of the adder 29–29''' and no mutual influencing of the gage-meter circuits 11–11''' takes place. However, the storage 28–28''' can also be stopped, so that from that moment on the actual input signals of the adder 18–18''' are subtracted from the stored signal. The storage coupling circuits 22–27 effect a corresponding material-dependent coupling of the gage-meter circuits 11–11'''.

A measurement circuit 30–30''' is provided for determining long-time deviations. Measuring circuit 30–30''' measures the actual thicknesses of the flanges and of the web and compares the thicknesses to the desired values. The output signals of the measuring circuits 30–30''' are also switched to the respective position control circuit and serve to correct the adjustment.

While a specific embodiment of the invention has been shown and described in detail to illustrate the application of the inventive principles, it will be understood that the invention may be embodied otherwise without departing from such principles.

We claim:

1. A method for controlling the thicknesses of webs and flanges of beam sections in universal rolling mill stands having horizontal rolls and vertical rolls, with hydraulic adjusting means for each roll and position control circuits for each adjusting means, the method comprising;

compensating short-time deviations of the webs and flange thicknesses through a gage-meter circuit provided for each roll by adding in the gage-meter circuits the actual rolling forces by means of actual pressure value indicators provided at hydraulic adjusting cylinders acting on the rolls to the desired rolling forces, and entering additional desired values, resulting from force differences between a reference force and the measured rolling force, into the position control circuits as a first correction value, determining long-time deviations of the webs and flange thicknesses by means of measuring circuits and comparing the measured actual position values with desired position and entering the comparison results in the position control circuit as a second correction value;

presetting the desired degree of compensation of short-time deviations; and coupling the gage-meter circuits to each other for a mutual influencing of the short-time deviation compensation and presetting initiation of the coupling of the gage-meter circuits to each other for an at least partial compensation of secondary short-time deviation occurring during a control procedure, wherein material-dependent and rolling-technological interrelations during coupling are called from storage-compensation circuits.

2. An arrangement for controlling the thicknesses of webs and flanges of beam sections rolled in universal rolling mill stands including horizontal rolls and vertical rolls, each roll being adjustable by means of hydraulic adjusting means, comprising a position control circuit for each hydraulic adjusting means of each roll, a gage-meter circuit provided for each roll, each gage-meter circuit including a pickup for the actual rolling force and a comparator for comparing the actual rolling force with the desired rolling force, wherein the comparison result is added on the position control circuit of each roll as a first position correction value, at least one measuring circuit for determining long-time position deviations, the measuring circuit also including means for determining the actual position values and means for comparing the actual position values with the desired position values, wherein the comparison result is added on the position control circuit, an attenuating member for adjusting the degree of the desired compensation being provided between each gage-meter circuit and the corresponding position control circuit, coupling circuits being provided between the individual gage-meter circuits, the coupling circuits providing a mutual influencing between the gage-meter circuits, and means for presetting the degree of coupling and the starting point of coupling whereby secondary short-time deviations are compensated.

3. The arrangement according to claim 2, wherein a separate position control circuit and a gage-meter circuit is provided for an upper horizontal roll and two vertical rolls of the stand.

4. The arrangement according to claim 3, wherein pairs of position control circuits and gage-meter circuits are provided for the horizontal rolls and the vertical rolls.

5. The arrangement according to claim 2, wherein the at least one measuring circuit is a sensor.

6. The arrangement according to claim 2, wherein the at least one measuring circuit is an adjusting means.

7. The arrangement according to claim 2, wherein the at least one measuring circuit is a computed model which is rolling schedule-dependent.

* * * * *